United States Patent [19]

Dawson

[11] Patent Number: 4,481,502

[45] Date of Patent: Nov. 6, 1984

[54] CENTRAL SMOKE ALARM AND ANNUNCIATOR

[76] Inventor: N. Rick Dawson, 220 Fentress Blvd., Daytona Beach, Fla. 32014

[21] Appl. No.: 362,554

[22] Filed: Mar. 26, 1982

[51] Int. Cl.[3] ..... G08B 29/00

[52] U.S. Cl. ..... 340/516; 340/512; 340/628; 340/629

[58] Field of Search ..... 340/628, 629, 630, 514, 340/515, 516, 512, 517; 250/381, 384

[56] References Cited

U.S. PATENT DOCUMENTS

| | | | |
|---|---|---|---|
| 2,646,556 | 7/1953 | Allen | 340/629 X |
| 3,160,866 | 12/1964 | Meili | 340/629 X |
| 3,530,450 | 9/1970 | Walthard et al. | 340/515 |
| 3,564,524 | 2/1971 | Walthard et al. | 340/515 |
| 3,588,892 | 6/1971 | Scheidweiler | 340/515 |
| 3,603,949 | 8/1971 | Walthard | 340/629 X |
| 3,657,713 | 4/1972 | Sasaki et al. | 340/515 X |
| 3,665,461 | 5/1972 | Gnägi et al. | 340/512 |
| 3,952,294 | 4/1976 | Emerson et al. | 340/629 X |
| 4,088,986 | 5/1978 | Boucher | 340/516 X |
| 4,287,515 | 9/1981 | Raber et al. | 340/517 X |

*Primary Examiner*—James L. Rowland
*Assistant Examiner*—Daniel Myer
*Attorney, Agent, or Firm*—Duckworth, Allen, Dyer, & Pettis

[57] ABSTRACT

A central smoke detection system for a building having multiple rooms utilizes low cost commercial smoke detectors in each room. Each detector includes a steady high current alarm mode, a low current idle mode and a high pulse current test mode. A central power source supplies power to the detectors via one common lead and a separate power lead to each detector. A resistor in each power lead at the central location provides for monitoring of the mode of each smoke detector. A central monitor operates a visual smoke alarm responsive to the steady high current mode which indicates the room in which a detector is in the alarm mode and a visual fault alarm responsive to the absence of the high test pulse current indicating the room in which a detector is inoperative. A common central smoke and fault alarm, both audible and visual is also provided.

14 Claims, 6 Drawing Figures

CENTRAL SMOKE ALARM AND ANNUNCIATOR

BACKGROUND OF THE INVENTION

1. Field of the Invention.

The present invention is related to a central annunciator and dynamic supervision system for smoke detection, and more particularly to a system for hotels, motels and apartment houses that will alert the area involved and a central location to an alarm and that is continually self-testing.

2. Description of the Prior Art.

In recent years, the development of low cost, efficient smoke detectors has provided reliable and economical protection of homes, rooms and offices. However, in multiple room structures such as motels, hotels, office buildings and the like, individual smoke detectors are of less value since rooms may not be occupied and a fire may be well under way before it is detected. There is therefore a need in such structures for central annunciation of conditions indicating the presence of smoke or other products of combustion.

Individual smoke detectors have been used having auxiliary switch contacts wired to a central annunciator. This type has proven relatively expensive since the units are not in mass production. In addition, the contact wiring does not provide means for supervision to ensure that all units are operating properly. It is also desirable to provide central power for all units to obviate the individual battery problem. Typical attempts in the prior art include U.S. Pat. No. 3,587,095 to Earling who shows a complex ac powered system having large numbers of electrical relays which may present reliability problems. Kabat teaches, in U.S. Pat. No. 4,017,852, connection of a number of smoke detectors together such that actuation of one alarm causes all alarms to sound. However, no means for indicating the location of the smoke or fire is provided.

SUMMARY OF THE INVENTION

The present invention utilizes a multiplicity of readily available battery type smoke detectors, such as the Fyrnetics Model No. 0900 with one unit installed in each room to be protected. The Model 0900 unit uses an integrated circuit produced by the Motorola Corporation which provides a periodic battery test capability used in the invention. Since this IC is available to the smoke detector industry, a number of other manufacturers' units are also available having the periodic test capability. The preferred smoke detector is originally battery powered and draws about 9–10 ua under normal conditions. The battery test timing circuit places a 10 ma load on the battery for about 10 ms every 40 seconds. A detector circuit measures the battery voltage during the loaded period and presents an audible signal if the voltage is low, alerting the user to the end of the battery life.

The present invention contemplates removing the batteries from all of the individual room units and powering each unit from a central, well regulated 10 volt dc source over a pair of wires. A central annunciator panel includes a visible alarm signal for each room labeled with the room number, a central audible alarm, and central smoke and fault visible alarm signals. A smoke condition in a room is indicated by operation of that room's signal. Simultaneously, the central visible alarm and audible alarms are energized. When a detector fault condition is indicated, the central visible alarm and audible alarms are also energized. A central logic supervisory circuit monitors the current in the power lead of each smoke detector. When the 10 ma, 10 ms test pulse occurs, a first latch is set in its centrally located monitor circuit. A central timing pulse reads the first latch periodically; for example, every two minutes. A strobe pulse following the timer pulse resets the first latch. If the first latch is not set when read indicating that the test pulse was not received, a second latch causes a fault alarm and indicator to be energized. Thus, if the test pulses occur every 40 seconds, normal operation of the detector is indicated and no fault alarm occurs. However, if the internal circuitry of the smoke detector unit fails, or it becomes damaged or disconnected from the system, the fault is detected by the supervisory circuit within 2 to 4 minutes and the fault alarm energized. The visual alarm signal indicator on the annunciator will show the room location of the defective unit.

When an actual smoke alarm is set off in a room, the local audible alarm draws about 10 ma of steady current. The supervisory logic circuit notes the steady current and produces a pulsating output signal used to energize the central audible alarm, and the visual alarm which identifies the affected room.

The central unit includes: a supervisory logic monitor for each smoke detector, each having an individual light emitting diode (LED) alarm indicator on a central annunciator panel; a common input circuit which operates separate central fault and smoke LED alarms and audible alarms; manual alarm controls; a timing generator; and a test and reference pulse generator.

When a smoke alarm occurs from one smoke detector unit, the individual LED on the central annunciator for the room in which the abnormal condition is present will flash rapidly. The central visual smoke alarm will also flash and an audible buzzer alarm or the like will sound. The audible alarm can be silenced. When a fault occurs in one of the smoke detectors, the LED associated with that detector on the annunciator panel will be energized steadily and the central fault alarm LED will also be energized steadily and the central fault LED will also be illuminated. An interrupted audible alarm will sound. A priority circuit for the central alarm will sound. A priority circuit for the central alarm oriented to the smoke alarm is provided in case a fault alarm and a smoke alarm occur at the same time.

The power supply includes a back-up battery supply to permit system operation during power outages or failures.

DETAILED DESCRIPTION OF THE PREFERRED EMBODIMENT

The invention comprises a plurality of individual commercially available smoke detectors that have an internal periodic battery testing function and which have a large ratio between standby current and alarm current. A typical suitable detector as previously mentioned is the Fyrnetics Model 0900 unit.

Figure 1:
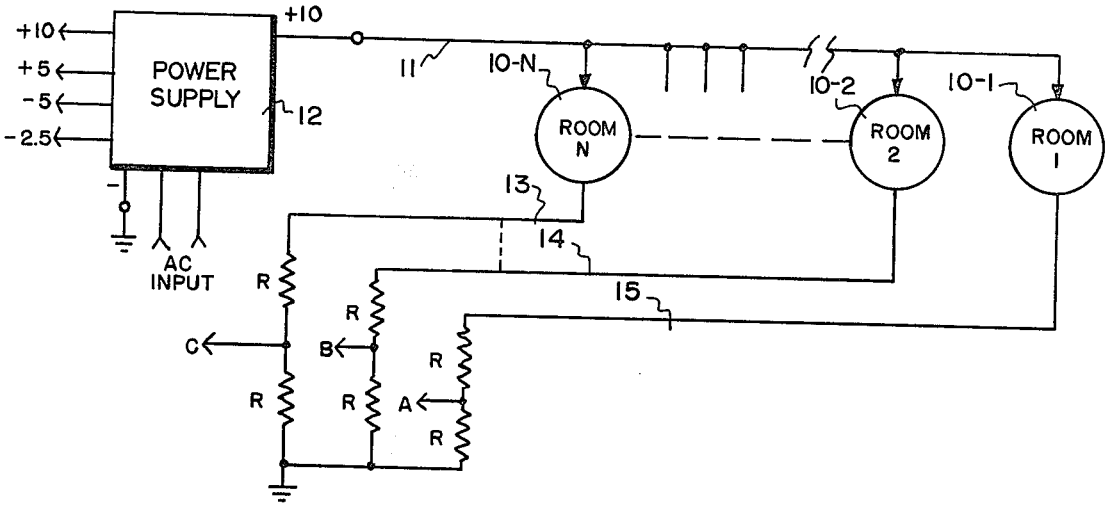
FIG. 1 is a simplified diagram showing a group of individual smoke detectors in a hotel or the like wired to a common power supply and having means for monitoring and supervision at a central location.

As indicated in FIG. 1, a centralized power supply 12 having a regulated +10 volts output is utilized to supply the smoke detectors 10 with operating potential via common positive lead 11 connected to all of the detectors in the building. As will be understood, the originally supplied battery in each smoke detector is removed. The negative potential return lead from each detector is brought to the central location. For example, detector 10-1 in room 1 has its negative lead 15 returned to the central location and connected to two series resistors R to ground which represents the negative terminal of power supply 12. Resistors R are provided to supply a voltage at output A proportional to the current flowing to the smoke detector 10-1 in room 1. Therefore, resistors R may have a low value; for example, 47 ohms has been found satisfactory. Similarly, smoke detector 10-2 in room 2 has a negative return lead 14 to produce a voltage output at B and smoke detector 10-N in room N has a negative return lead 13 for producing an output voltage at C.

In accordance with the operation of the smoke detectors 10 under normal standby conditions, approximately 10 ua will flow in the return leads 13-15 and consequently voltages A, B and C will be very low. During an alarm condition, approximately 10 ma is drawn by the audible and visual alarms in a smoke detector 10. Assuming that the dectector 10-1 in room 1 is in an alarm condition, the voltage at A will therefore greatly increase from its standby condition and is therefore usuable to indicate at the central location the occurrence of an alarm. In addition to the increase of current during an alarm condition, each smoke detector 10 will periodically place a load on the power supply which increases the current flow to about 10 ma for a very short time, such as 10 ms. This occurs at about 40 second intervals. The smoke detector 10 includes a voltage measuring circuit which is also activated during the 10 ms pulse for the purpose of producing a warning alarm when the originally supplied battery voltage drops to a preselected lower value, thereby permitting the user to replace the battery before it is completely exhausted. In accordance with the present invention, the battery is removed and operating potentials are furnished by power supply 12. Thus, the voltage test feature is not required. However, the 10 ms, 10 ma pulse creates a voltage pulse at the monitoring outputs A, B and C when the pulses occur in their respective smoke detectors. This pulse may be continually monitored as an indication that the smoke detectors are in normal operation.

In the event of a failure of components in the smoke detector 10 or an accidental breakage of one of the power lines, this pulse would no longer be received at the central location and such absence of pulse may then be utilized to indicate a fault such that the indicated faulty alarm can be repaired. Power supply 12 may be normally powered from the ac power lines but may also include storage batteries which are normally on trickle charge. The batteries permit powering the system in an event of a loss of ac power which may happen in case of a fire. Power supply 12 also supplies regulated voltage +10, +5, −5 and −2½ to the monitoring of supervisory circuits to be described below.

Figure 2:
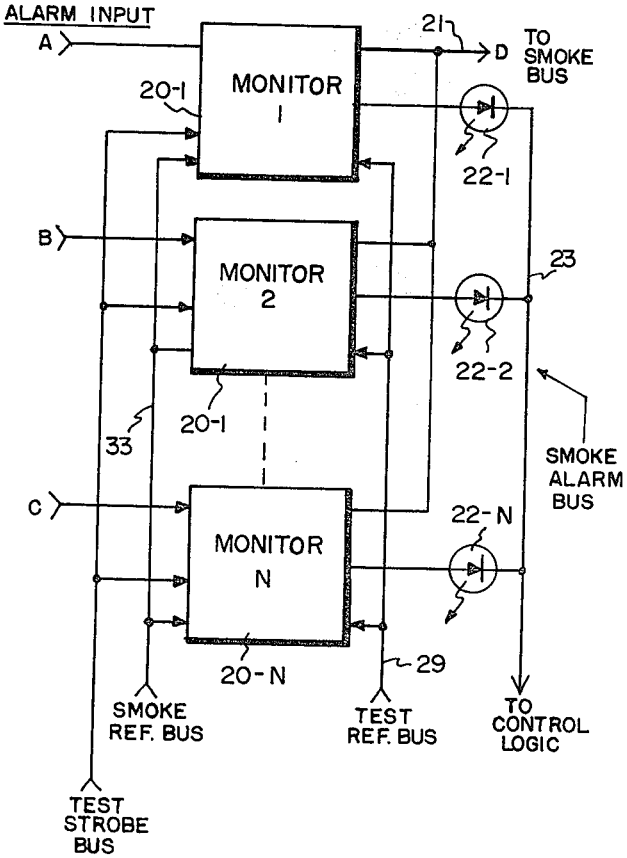
FIG. 2 is a simplified block diagram showing a set of monitors and alarm indicators for the system of FIG. 1.

Turning to FIG. 2, a simplified block diagram of the monitoring circuits for the system of FIG. 1 is shown. A monitor circuit 20-1 is shown which receives an input from output A in the negative power supply line from room 1 and smoke detector 10-1 of FIG. 1. Similarly, monitor circuit 20-2 receives output B from smoke detector 10-2 in room 2 and monitor 20-N receives the output signal C from smoke detector 10-N in room N. Monitor circuits 20 also receive signals from a test strobe bus, a smoke reference bus, and a test reference bus which control the monitoring for a smoke alarm condition and for fault detection as will be explained in more detail hereinafter.

Monitors 20 function to produce an output to LED's 22 when a smoke alarm condition or a fault condition is noted by a monitor 20. For example, assume that monitor 20-1 receives a steady 10 ma signal at input A which indicates that smoke alarm 10-1 in room 1 has been triggered by the presence of smoke. Monitor 20-1 will then output a rapid intermittent alarm signal to LED 22-1 which will therefore flash. It is contemplated that a display panel will be provided at a central monitoring point where personnel are normally present. The pulsating alarm signal from monitor 20-1 will also be transmitted on smoke bus 21 to a control logic circuit to be described later which sounds a central audible alarm and visual alarm, and may also energize auxiliary alarms. Monitor circuit 20-1 also places a pulsating smoke signal on smoke alarm bus 23 at output D. This signal is used in conjunction with the smoke bus 21 to assure that fault signals and smoke signals will be detected when both are present at the same time as will be explained in more detail hereinafter.

Monitor circuits 20 also detect the presence of the normal 10 ms, 10 ma periodic test pulses. However, when a test pulse does not appear over a short period, which may be two minutes for example, a steady fault alarm output voltage is produced to LED 22 and an audible alarm energized via lead 23. Thus, the steady illumination of an individual room LED 22 indicates to the central personnel that a fault exists in the smoke detector associated with that LED. Advantageously, the LED's 22 serve for either a smoke alarm indication by a pulsating light or a fault alarm indication by a steady light. As may be noted below, priority for a smoke alarm is provided in case both fault and smoke detection would occur at the same time.

Figure 3:
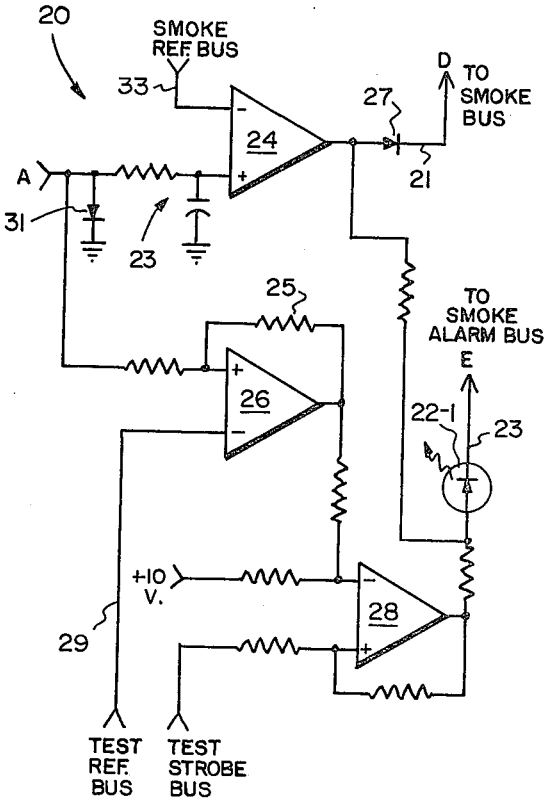
FIG. 3 shows a schematic diagram of a monitor circuit of FIG. 2.

FIG. 3 is a typical schematic diagram of a monitor 20 of FIG. 2. Input A from the return lead for smoke detector 10-1 in room 1 will be used for explaining the operation of monitor circuit 20. Normally with about 10 ua flowing, and assuming a resistance of 47 ohms for resistor R, the voltage at A will be about 0.47 mv. When the smoke detector goes through its self test routine about once every 40 seconds, there will be 10 ma drawn through resistor R for about 10 ms producing a voltage of about 0.47 volts at A which will be referred to as the test pulse. Input A feeds two operational amplifiers (op-amp) 24 and 26. The time constant of RC network 23 is selected to be on the order of 0.3 seconds; therefore, the 10 ms test pulse will not appear at the non-inverting input of op-amp 24. However, it will appear at the non-inverting input of op-amp 26. The inverting input of op-amplifier 26 is normally held at 0.325 volts from test reference bus 29. The test pulse therefore causes a high at the output of op-amp 26 which is fed back by resistor 25 causing op-amp 26 to function as a latch. Thus, the output of op-amp 26 will remain high following each test pulse.

The voltage on test reference bus 29 to the inverting input of op-amp 26 will go to +2 volts every two minutes for about 120 ms. This will reset latch 26 to await the occurrence of the next test pulse. Operation amplifier 28, along with its resistor network, acts as a modified D-latch. This circuit reads the latch formed by op-amp 26 as previously described when the voltage on test strobe bus goes from its normal +2.0 volts to +5.3 volts for about 120 ms. This occurs once every 2 minutes and just precedes the transition on the test reference bus. If the test pulse has not been received at A and the output of op-amp 26 remains low when the +5.3 volt pulse on the test strobe bus occurs, the low level at the output of op-amp 26 is transferred to op-amp 28 in a typical D-latch fashion where it is then inverted. If the test pulse is subsequently received, causing the output of op-amp 26 to go high, the output of the D-latch op-amp 28 will be immediately cleared to its normal low state. However, assuming that the test pulse does not appear at A, the output of D-latch 28 will remain high causing LED 22-1 to produce steady illumination indicative of a fault. The signal is also transferred to the smoke alarm bus 23 and is used by the control logic to detect the presence of the fault alarm.

As previously mentioned, when a smoke detector 10 in any room senses smoke, it sounds its local alarm. Assuming an alarm from detector 10-1, as previously mentioned, a steady current of about 10 ma will be drawn producing a steady voltage of about 0.47 volts at A. The voltage is clamped by diode 31. After the short time delay from RC circuit 23, this voltage appears at the non-inverting input of op-amp 24. The timing waveform shown at line T-1 of FIG. 4 which alternates between +0.325 volts and +2 volts every 120 ms, appears at the inverting input of op-amp 24. When the smoke alarm signal appears at the non-inverting input, the alternating signal on smoke reference bus 33 causes the output of op-amp 24 to alternate between high and low at the same rate. This causes LED 22-1 to flash at about a 4 Hz rate. The flashing voltage also appears on lead 21 to the control logic which interprets the flashing voltage on the smoke bus to determine that one or more rooms have experienced smoke.

Figure 4:
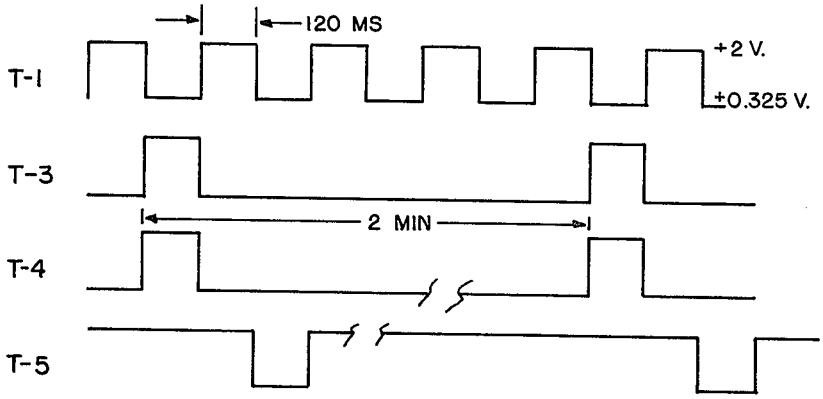
FIG. 4 shows a waveform diagram of timing signals generated in a timing generator and utilized in the monitoring and supervision system of the invention.
Figure 5:
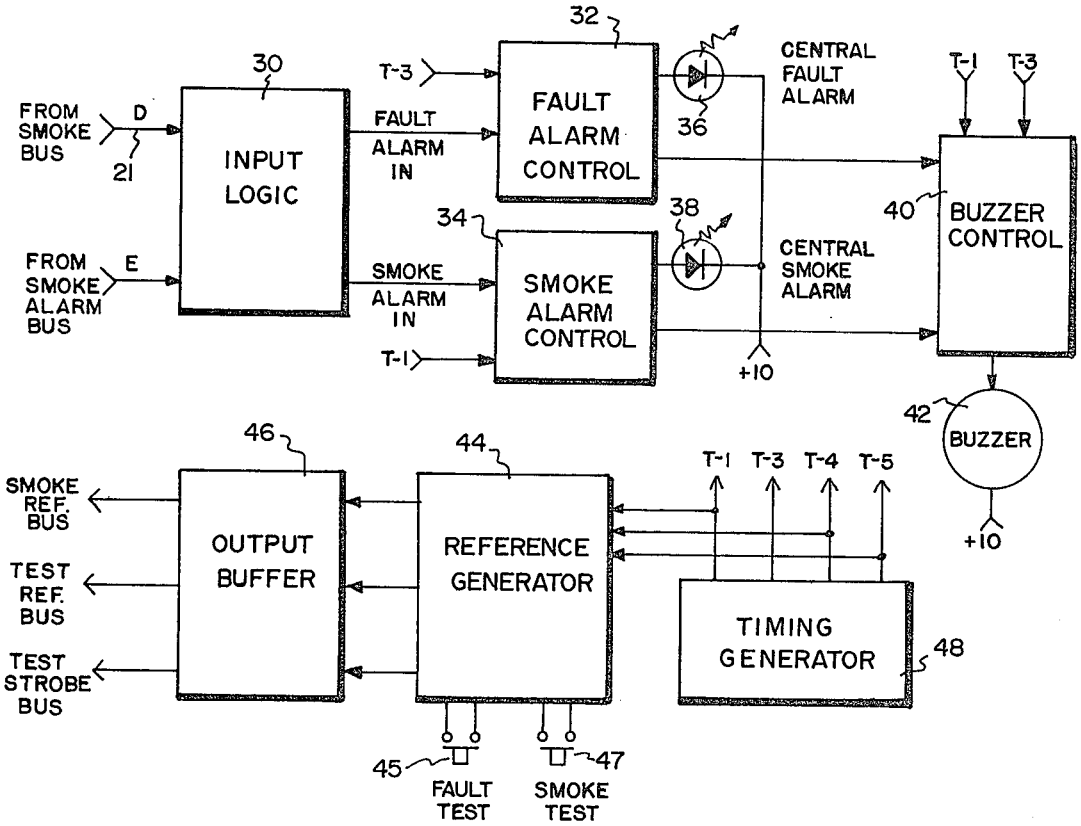
FIG. 5 is a simplified block diagram of the central monitoring and supervision system of the invention.

FIG. 5 shows a block diagram of the central control system of the invention. Input logic 30 serves to identify the type of alarm appearing on the smoke alarm bus E. If the signal is steady, as in a fault alarm, it is transferred to fault alarm control 32. Fault alarm control 32 operates LED 36 which may be yellow and is used as a central fault alarm for alerting personnel that a fault exists in at least one of the room smoke detectors. At the same time, fault alarm control 32 energizes buzzer control 40 which will operate buzzer 42 to produce an audible alarm. Buzzer control 40 receives the timing signal T-1 which, from FIG. 4, is seen to be 4 Hz pulsating signal and T-3 which is an intermittent signal occuring at a rate of about 1 Hz. When the alarm is indicative of a fault, the buzzer is controlled by T-3 to give the 1 Hz intermittent tone. When a signal appears at input logic 30 on smoke bus D, input logic 30 identifies this signal as indicating a smoke alarm and energizes smoke alarm control 34. A separate LED 38, which may be for example red, flashes rapidly to indicate a smoke condition in at least one of the rooms. Smoke alarm control 34 also energizes buzzer control 40 which in this case also utilizes signal T-1 to operate the buzzer giving a rapidly interrupted buzzer tone permitting personnel to distinguish audibly between a smoke alarm for which there is great urgency and for a fault alarm which is not as urgent. Alarm controls 32 and 34 include means for manually silencing the buzzer once it has been noted. However, the LED's 36 and 38 when energized will continue to flash until the problem is corrected.

A timing generator 48 is used to produce the four timing signals T-1, T-3, T-4 and T-5 shown in FIG. 4. As previously noted, T-1 and T-3 are utilized by the alarm control circuits 32 and 34 and buzzer control circuit 40. Additionally, signals T-1, T-4 and T-5 are used by reference generator 44 to generate the signals appearing on the smoke reference bus, the test reference bus, and the test strobe bus. A fault test push button 45 and a smoke test push button 47 are also provided to permit occasional testing to ensure that the LED alarms and the audible alarms are working properly.

Figure 6:
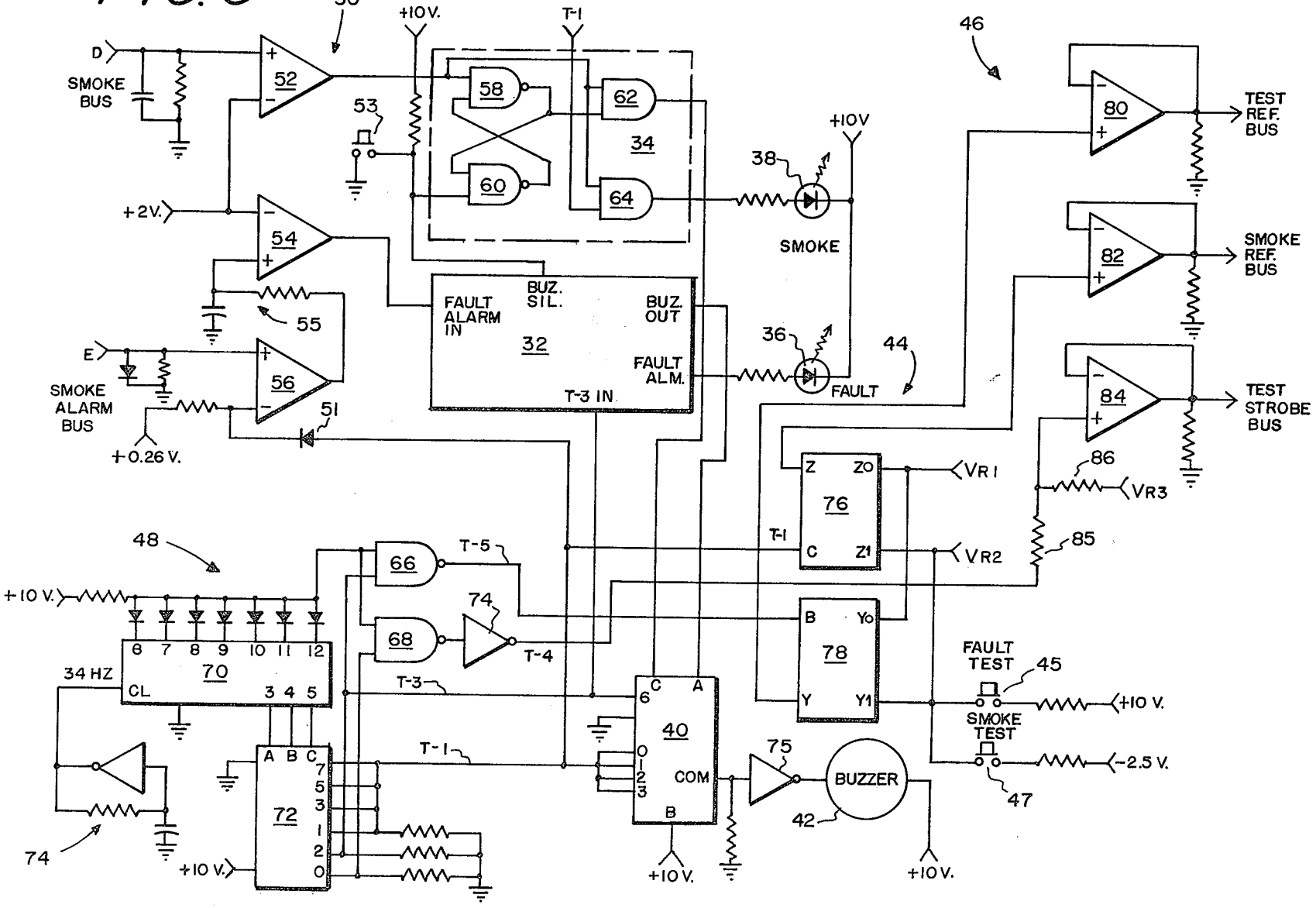
FIG. 6 is a schematic diagram of the system of FIG. 5.

Referring now to FIG. 6 a schematic diagram of the control system of FIG. 5 is shown. As described with reference to FIG. 3, when any room is in the smoke condition, a 4 Hz flashing voltage appears on smoke bus D. Filtered by the capacitor, this steady signal is present at the non-inverting input of op-amp 52. Therefore, the op-amp 52 output is high whenever any room is experiencing a smoke condition. The return from each LED 22 on smoke alarm bus E produces a voltage at the non-inverting input of op-amp 56 also. However, diode 51 receives waveform T-1 and applies it to the inverting input of op-amp 56. It may be noted that this voltage will be in phase with the flashing smoke signal and the output of op-amp 56 will therefore remain low. If a fault condition were present as indicated by a steady voltage on input E, the output of op-amp 56 will alternate between high and low due to the waveform T-1 on its inverting input. The output from op-amp 56 from a fault alarm is integrated by RC network 55 and detected by op-amp 54. Thus, a signal from op-amp 54 to the input of fault alarm control 32 occurs. The output of op-amp 52 connects to smoke alarm control 34 which is identical to fault alarm control 32.

The alarm control circuits have the function of producing an output for the appropriate LED with a flashing or pulsing pattern determined by the type of alarm and a steady buzzer output control signal. Push button 53 operates a silence latch for silencing a steady buzzer output. The LED output from alarm control 34 connects to LED 38 which is labeled "SMOKE" on the annunciator panel. Similarly, the output from control 32 connect to LED 36 which may be marked "FAULT". It may be desirable to use a red LED at 38 and a different color for the fault LED 36. When an output appears on op-amp 52, it is applied to one input of NAND gate 64 which gates through waveform T-1 to smoke LED 38 which will flash in accordance with waveform T-1. Additionally, a high at the output of op-amp 52 sets the bistable circuit produced by NAND gate 58 and 60 to enable gate 62 whose output connects to buzzer control 40 for operating buzzer 42 as controlled by waveform T-1. Depressing push button 53 will reset the bistable circuit, disabling gate 62 and silencing buzzer 42. An output from op-amp 54 causes a similar operation of fault alarm control 32 with LED 36 being flashed at a rate being determined by waveform T-3. Buzzer control 40 is energized by the input from fault alarm control 32 at A which causes buzzer 42 to be operated under control of waveform T-3. Silence button 53 will also permit silencing of the fault alarm buzzer. Buzzer control 40, which may be a type MC14051 3 line to 8 line binary decoder, also provides priority for the smoke alarm signal at input C. That is to say, if the buzzer were operating in response to a fault alarm and a smoke alarm occurred, control 40 would cause the buzzer to operate at the higher rate as controlled by waveform T-1 rather than waveform T-3.

Timing generator 48 utilizes ripple counter 70, which may be a type MC14040, and decoder 72 which may be a type MC14051. The frequency of operation is set by oscillator 74 which may be operating at 34 Hz. Waveform T-5, which generates the test reference signal, is produced at the output of gate 66, T-4 which generates the test strobe signal appearing at the output of inverter 74, while T-3 which controls the fault alarm flash rate and T-1 which controls the smoke alarm flash rate are taken from decoder 72. Analog switches 76 and 78 are used in conjunction with fault test button 45 and smoke test button 47 to select the appropriate voltage levels for the test reference bus and the smoke reference bus and to produce simulated fault test signals and smoke test signals on the respective buses. Voltage reference is combined with T-4 by resistors 86 and 85 to produce the test strobe signals. Amplifiers 80, 82 and 84 of output buffer 46 isolate the various buses from the reference signals at their inputs.

I claim:

1. In a system having a plurality of remote electronic smoke detectors, each detector having a low electrical current idle condition, a steady high electrical current alarm condition, and a periodic high electrical current test condition, the centralized smoke and fault alarm system comprising:

a plurality of current sensing means at a central location for monitoring separately the current to each of said smoke detectors, each of said current sensing means producing a first output signal responsive to said steady high current alarm condition and a second output signal responsive to the absence of said periodic high current test condition of its associated smoke detector;

a plurality of alarm indicators wherein each of said current sensing means is connected to one of said indicators, each of said indicators for identifying the location of its associated smoke detector, for producing a smoke alarm indication responsive to said first output signal and for producing a fault indication responsive to said second output signal; and a common alarm connected to said plurality of current sensing means for producing a common audible and visual alarm signal in response to a smoke alarm or a fault alarm from any of said plurality of remote smoke detectors.

2. The system as defined in claim 1 which further comprises a common power supply for said plurality of smoke detectors.

3. The system as defined in claim 2 in which said current sensing means includes:

a separate power supply lead to each of said plurality of smoke detectors; and a series resistor in each said power supply lead.

4. The system as defined in claim 3 in which said current sensing means further includes:

first comparator means having a first input connected to said series resistor for sensing the voltage across said resistor; and a smoke reference voltage source connected to a second input of said first comparator means, said comparator means producing said first alarm signal when a steady voltage at said first input exceeds the smoke reference voltage at said second input.

5. The system as defined in claim 4 in which said current sensing means further includes:

second comparator means connected to said first input of said first comparator means and adapted to latch when a periodic test condition voltage pulse occurs across said resistor;

a periodic test reference voltage source connected to a second input of said second comparator means for producing a periodic test reference voltage pulse for resetting said second comparator means when latched;

a D-latch having a first input connected to the output of said second comparator; and a periodic test strobe voltage source connected to a second input of said D-latch, said current sensing means producing said second alarm signal when said periodic test condition voltage pulse does not occur during successive periodic test reference voltage pulses.

6. The system as defined in claim 4 in which:

each of said alarm indicators is a light emitting diode;

said smoke alarm indication is a rapid flashing of said light emitting diode; and said fault indication is a slow flashing of said light emitting diode.

7. The system as defined in claim 1 in which said common alarm includes:

input logic means for identifying the type of alarm received from said current sensing means;

smoke alarm control means connected to said input logic means for energizing a visual central smoke alarm indicator;

fault alarm control means connected to said input logic means for energizing a visual fault alarm indicator;

a first visual alarm indicator connected to said smoke alarm control means;

a second visual alarm indicator connected to said fault alarm control means;

audible alarm control means connected to said smoke alarm control means and said fault alarm control means for producing a first audible alarm representative of a smoke alarm and a second audible alarm representative of a fault alarm; and an audible alarm means connected to said audible control alarm means.

8. The system as defined in claim 7 in which:

said visual central smoke and fault alarm indicators are light emitting diodes; and said audible alarm means is a buzzer.

9. The system as defined in claim 7 in which said audible alarm control means includes means for manually silencing an audible alarm.

10. The system as defined in claim 7 in which said audible alarm control means includes selection means for producing said first audible alarm representative of a smoke alarm when both smoke and fault alarms are received simultaneously.

11. The system as defined in claim 7 which further comprises:

timing and reference generator means including said smoke reference voltage source, said periodic test reference voltage source and said periodic test strobe voltage source; said timing generator means further including a fault alarm timing voltage source;

fault test control means for manual testing of said fault alarm; and smoke test control means for manual testing of said smoke alarm.

12. The system as defined in claim 7 in which said audible alarm control means is connected to said smoke reference voltage source for controlling said first audible alarm and to said fault alarm timing voltage source for controlling said second audible alarm.

13. A central smoke detection, alarm and annunciation system for a building having multiple rooms with each room having an electronic smoke detector, said detector drawing a very low current in a non-alarm condition, a steady high current in an alarm condition, and producing a periodic high current test pulse, comprising:

a common direct current power supply having a common power bus connecting to each said detector in each of said rooms and a separate return power lead from each said detector;

a resistor in each said separate return power lead for producing a voltage thereacross, said non-alarm condition producing a very low non-alarm voltage, said alarm condition producing a steady higher alarm voltage, and said test pulse producing a higher test voltage pulse;

a monitor circuit connected across each said resistor for monitoring for said steady alarm voltage and said test voltage pulse;

a visual indicator connected to the output of each said monitor circuit, said indicator including an identification of the room location of the smoke detector associated therewith, said monitor circuit causing said indicator to flash at a first rate responsive to said alarm voltage indicative of a smoke alarm, and causing said indicator to flash at a second rate responsive to the absence of said test voltage pulse indicative of a fault in the smoke detector associated therewith; and a common visual alarm control and a common audible alarm control each connected to the output of said monitor circuit and responsive to a smoke alarm output therefrom or a fault alarm output therefrom for producing a common visual and audible alarm.

14. The system as defined in claim 13 in which said alarm control includes means for producing an audible smoke alarm when a smoke alarm and a fault alarm occur simultaneously.

* * * * *